US007717770B1

(12) United States Patent
Peterson et al.

(10) Patent No.: US 7,717,770 B1
(45) Date of Patent: May 18, 2010

(54) EXPANSION JOINT GRINDER

(76) Inventors: Clayton R Peterson, 63 Calle Cadiz Unit D, Laguna Woods, CA (US) 92637; Sandford Gray Dincolo, P.O. Box 399, Rancho Cucamonga, CA (US) 91729

( * ) Notice: Subject to any disclaimer, the term of this patent is extended or adjusted under 35 U.S.C. 154(b) by 174 days.

(21) Appl. No.: 12/169,535

(22) Filed: Jul. 8, 2008

(51) Int. Cl.
*B28D 1/02* (2006.01)

(52) U.S. Cl. ..... 451/41; 299/39.3; 125/13.01

(58) Field of Classification Search ..... 451/41, 451/350, 352, 353, 547; 125/13.01, 13.03, 125/14, 38; 299/39.1, 39.3, 39.5
See application file for complete search history.

(56) References Cited

U.S. PATENT DOCUMENTS

| | | | | |
|---|---|---|---|---|
| 2,673,725 | A * | 3/1954 | Coates | 299/39.3 |
| 3,724,900 | A * | 4/1973 | Hatcher et al. | 299/39.6 |
| 3,934,377 | A | 1/1976 | Tertinek | |
| 4,109,635 | A | 8/1978 | Rossborough | |
| 5,042,208 | A | 8/1991 | Richardson | |
| 5,083,839 | A * | 1/1992 | Younger | 299/39.8 |
| 5,305,729 | A * | 4/1994 | Chiuminatta et al. | 125/12 |
| 5,507,273 | A * | 4/1996 | Chiuminatta et al. | 125/13.01 |
| 5,882,249 | A | 3/1999 | Ferland | |
| 6,250,295 | B1 | 6/2001 | Chanton et al. | |
| 6,739,963 | B1 | 5/2004 | Mas Garcia | |
| 7,137,875 | B2 | 11/2006 | Jeansson | |
| 7,143,760 | B2 | 12/2006 | Gardner | |
| 7,201,644 | B2 | 4/2007 | Gardner | |
| 2003/0127904 | A1 | 7/2003 | Due | |
| 2006/0189268 | A1 | 8/2006 | Falk | |

* cited by examiner

*Primary Examiner*—Robert Rose
(74) *Attorney, Agent, or Firm*—QuickPatents, Inc.; Kevin Prince

(57) ABSTRACT

An apparatus for grinding both inside surfaces of a concrete joint simultaneously is disclosed. The apparatus includes a proximal grinding wheel having a rotational axis and a grinding implement fixed with a proximal side, and an external drive shaft fixed to the center thereof. A distal grinding wheel is included that has the same rotational axis a grinding implement fixed with a distal side. An internal drive shaft is fixed partially within the external drive shaft and to the center of the distal grinding wheel. The apparatus further includes a means for moving both grinding wheels apart, a source of rotational kinetic energy, and a means for coupling the source of rotational kinetic energy to each drive shaft.

11 Claims, 3 Drawing Sheets

EXPANSION JOINT GRINDER

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to grinding devices, and more particularly to a concrete joint grinder for grinding both the inside surfaces of a concrete joint simultaneously.

DISCUSSION OF RELATED ART

A wide variety of grinders are used to grind floors and working surfaces in construction and remodeling industry. Conventional grinders are designed for grinding projects involving large working surfaces. Hand held grinders are operated in small proximity of wall surfaces. Hand held grinders require the operator to move along the wall either on the operator's knees or in bent position. This is tiresome and sometimes causes back or other injury to the operator. A major difficulty posed by the prior art grinders are that they can grind only one surface of a concrete joint at a time. The entire grinding process is time consuming and is expensive.

Several prior art devices are known to grind concrete surfaces. For example, U.S. Pat. No. 4,018,012 to Hopkins on Apr. 19, 1977 discloses a method of removing metals from the surface of a metal workpiece such as a steel slab or a billet. The grinding apparatus includes a plurality of grinding wheels about an axis extending transversely of the workpiece surface. The grinding elements are subjected to pressure which depends upon the pressure of a hydraulic fluid supplied from a source. Here the grinder can only grind one upper surface at a time. The grinding process is time consuming. Moreover, additional passes may be made to remove more metal and this is accomplished by reversing the workpiece at each end of its travel and continuing to move it back and forth as many times as necessary.

U.S. Pat. No. 4,109,635 to Rossborough on Aug. 29, 1978 discloses a grinder for grooved joints on a hollow concrete cylinder. Here the grooving apparatus includes a track structure centered on the axis of a surface to produce a groove of uniform radius. The track structure is a heavy counter weight which includes a ring gear, a carriage and a motor drive spur gear. The whole apparatus is bulky and difficult to handle, and not well suited for grinding both sides of a concrete joint simultaneously.

U.S. Pat. No. 6,786,556 to Due on Sep. 7, 2004 discloses a concrete grinder apparatus. The system uses a detachably mounted hand held concrete grinder with a configuration that mounts a hand-held grinder in either a right-facing orientation or a left-facing orientation. The hand held grinder can be worked only on a single, small surface area and requires the operator to move along the wall either on the operator's knees or in bent position. This is tiresome and can cause back or other injury to the operator.

U.S. Pat. No. 5,882,249 to Ferland on Mar. 16, 1999 discloses a concrete finishing machine. Here a flat rotating disk is held against a concrete surface to be finished and a variable speed control is manipulated by the user to smooth and finish the surface. A handle of the invention extends radially on opposite sides of a power take off and lies within a plane normal to the axis between the motor and the rotating disk. The variable speed control is disposed on the handle to allow the user to vary the revolution speed of the disk. Such a device is not well suited for grinding two surfaces of a concrete joint simultaneously while the operator maintains a relaxed position.

Therefore, there is a need for an apparatus that can grind both of the inside surfaces of a concrete joint simultaneously. Such an apparatus would be inexpensive, compact and easy to manipulate. Such an apparatus would be adapted to work on a large surface area with relatively minimal manual effort. The present invention accomplishes these objectives.

SUMMARY OF THE INVENTION

The present invention is an apparatus for grinding both inside surfaces of a concrete joint simultaneously. The apparatus includes a proximal grinding wheel and a distal grinding wheel. A rotational axis orthogonally intersects the proximal and distal grinding wheels at respective centers thereof. At least one grinding implement is fixed to a distal side of the distal grinding wheel proximate a peripheral edge thereof, and to a proximal side of the proximal grinding wheel proximate a peripheral edge thereof. An internal drive shaft is fixed partially within an external drive shaft, and each are co-aligned with the rotational axis of each grinding wheel and mutually slidably engaged.

The internal drive shaft is fixed to the distal grinding wheel, and the external drive shaft is fixed to the proximal grinding wheel. The proximal grinding wheel and distal grinding wheel are selectively moved apart by telescoping the internal drive shaft with respect to the external drive shaft. Preferably a biasing means urges the two grinding wheels apart. The distal grinding wheel and the proximal grinding wheel are mutually rotated by a means for coupling a source of rotational kinetic energy to each of the drive shafts. A wheeled support frame is preferably fixed to the source of rotational kinetic energy The present invention facilitates grinding both of the inside surfaces of a concrete joint simultaneously. Such an apparatus is relatively inexpensive, compact and easy to manipulate. Such an apparatus is adapted to work on a large surface area with relatively little manual effort. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
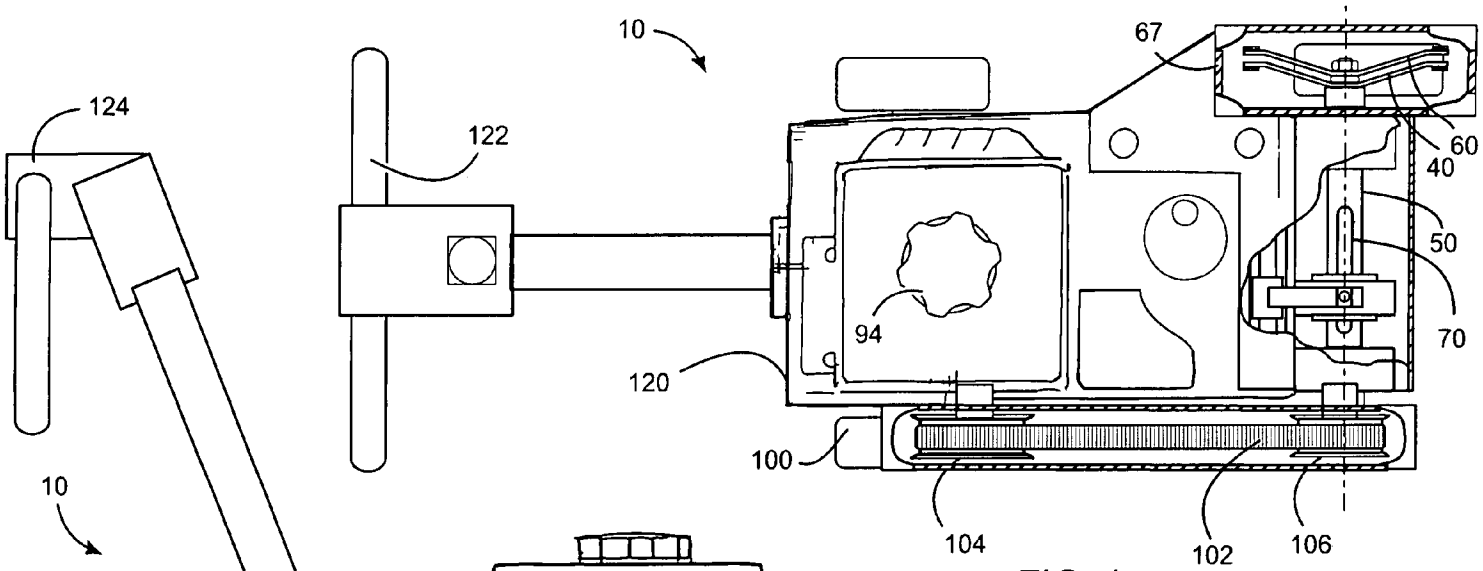
FIG. 1 is a top plan view, partially cut away, of the invention.
Figure 2:
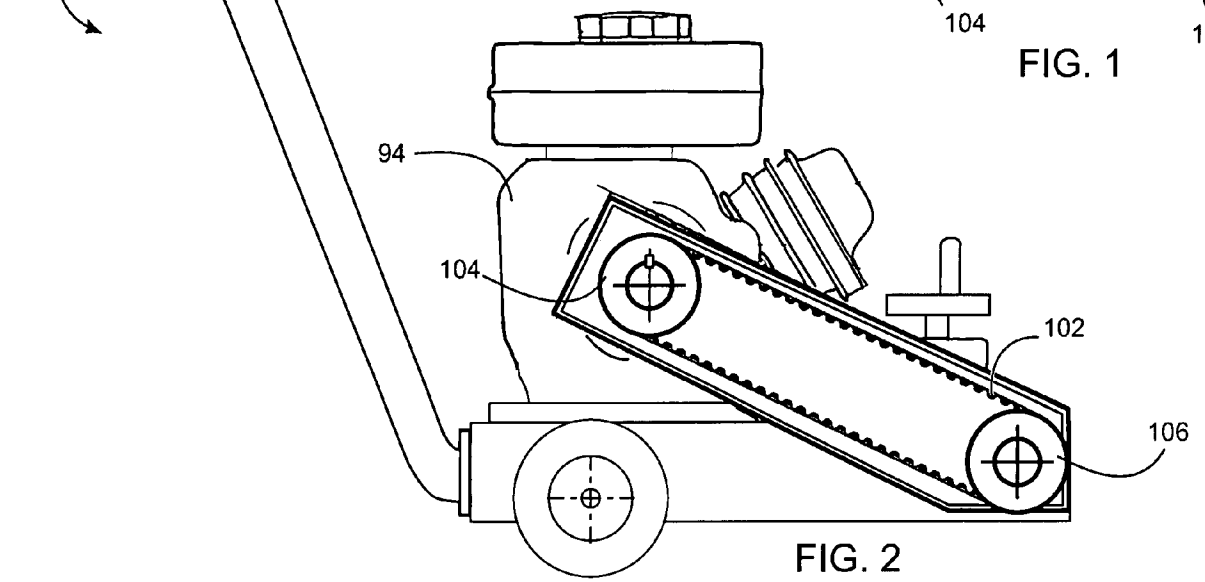
FIG. 2 is a right side elevational view of the invention, illustrating a means for coupling the source of rotational kinetic energy to external drive shaft and internal drive shaft.

FIG. 1 illustrates an apparatus 10 for grinding a pair of inside surfaces 20 of a concrete joint 30 simultaneously. The apparatus 10 includes a proximal grinding wheel 40 and a distal grinding wheel 60. The proximal grinding wheel 40 includes a proximal side 42, a distal side 44 and a peripheral edge 46 connecting both sides 42 and 44. A rotational axis 41 orthogonally intersects proximate the center (not shown) of the proximal grinding wheel 40. A grinding implement 45, such as a diamond or carbide cutting element, is fixed to the proximal side 42 of the proximal grinding wheel 40 proximate the peripheral edge 46 thereof.

An external drive shaft 50 is co-aligned with the rotational axis 41. A distal end 52 of the external drive shaft 50 is fixed to the center (not shown) of the proximal grinding wheel 40, such as with a threaded end and nut arrangement 47.

The distal grinding wheel 60 includes a proximal side 62, a distal side 64, and a peripheral edge 66 connecting both sides 62 and 64. The rotational axis 41 orthogonally intersects proximate the center (not shown) of the distal grinding wheel 60. A grinding implement 65, preferably identical to grinding element 45 but not necessarily so, is fixed to the distal side 64 proximate the peripheral edge 66. An internal drive shaft 70 is co-aligned with the rotational axis 41 and fixed partially within the external drive shaft 50. A distal end 72 of the internal drive shaft 70 is fixed to the center of the distal grinding wheel 60, such as with a threaded shaft and nut arrangement 67. The grinding wheels 40 and 60 can be enclosed within a protective case 67 to prevent debris and dust from being flung into the air during operation.

A moving means 80 provides for selectively moving the proximal grinding wheel 40 with respect to the distal grinding wheel 60 by telescopically moving the external drive shaft 50 with respect to the internal drive shaft 70. The moving means 80 preferably includes a longitudinal slot 85 in the external drive shaft 50 and a pin 86 fixed to the internal drive shaft 70. The pin 86 extends through the slot 85 of the external drive shaft 50. An actuator 88 is included to move the pin 86 within the longitudinal slot 85 to change the mutual proximity of the proximal grinding wheel 40 and the distal grinding wheel 60 (FIGS. 4 and 5).

The distal grinding wheel 60 and the proximal grinding wheel 40 are rotated by a coupling means 100 that couples the source of rotational kinetic energy 90 to each of the drive shafts 50,70. The source of rotational kinetic energy 90 is preferably a gasoline engine 92 or an electric motor 94 connected to an electric power source (not shown), such as an electrical power receptacle. The coupling means 100 preferably includes a drive belt 102 looped around a motor pulley 104 fixed to the source of rotational kinetic energy 90, and a shaft pulley 106 selectively coupled to the external drive shaft 50 through a clutch means 108 (what FIG?).

Figure 4:
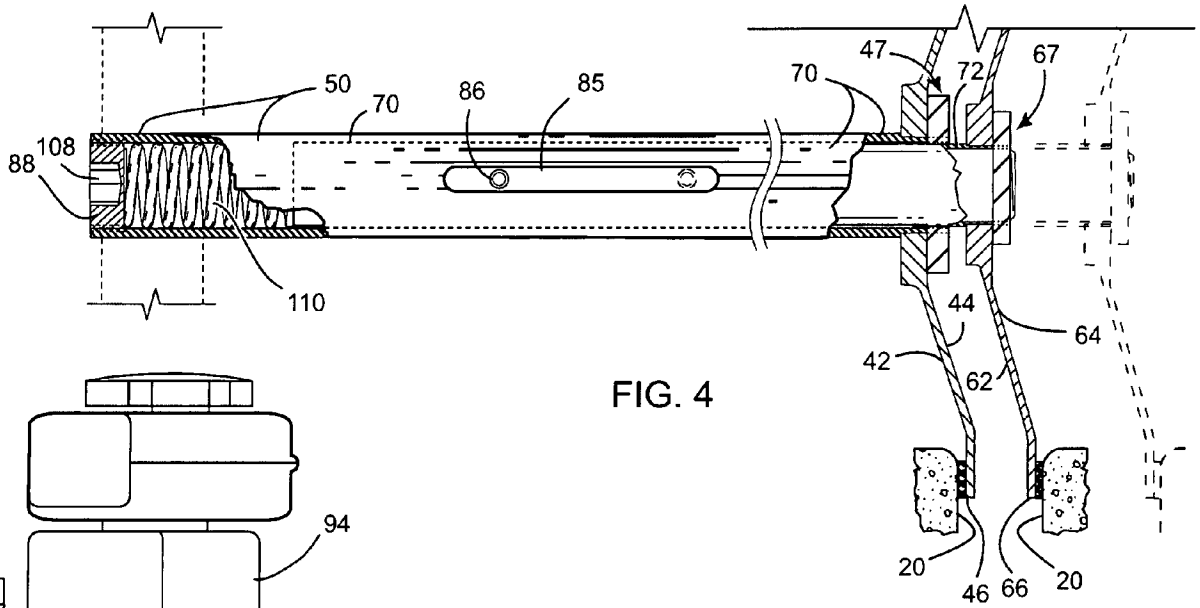
FIG. 4 is a partial top plan view of the invention, partially cut away, illustrating an internal and external drive shaft each fixed to a distal and proximal grinding wheel, respectively.
Figure 3:
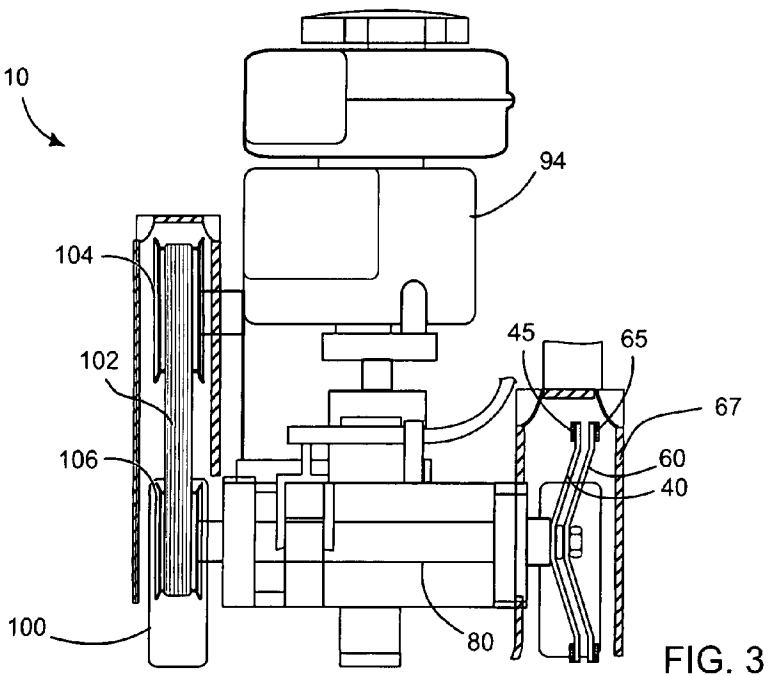
FIG. 3 is a front elevational view of the invention, shown partially cut away.
Figure 5:
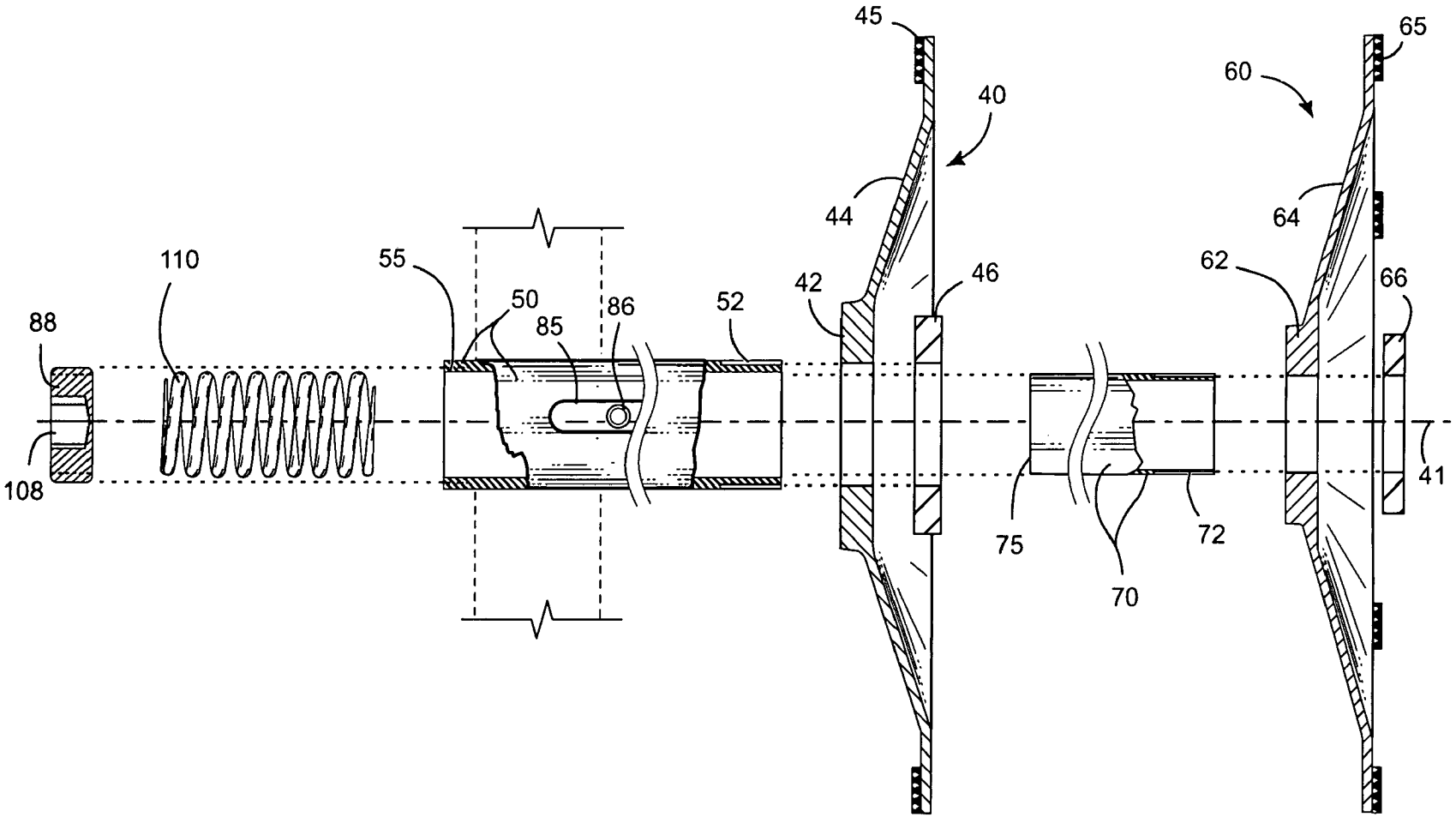
FIG. 5 is a partial exploded view of the drive shafts and grinding wheels of the invention.

The proximal end 55 of the external drive shaft 50 includes a biasing means 110 for biasing the proximal end 75 (FIG. 5) of the internal drive shaft 70 away from the proximal end 55 of the external drive shaft 50, thereby urging the distal grinding wheel 60 away from the proximal grinding wheel 40 (FIG. 4).

A wheeled support frame 120 is fixed to the source of rotational kinetic energy 90. The support frame 120 further includes a handle 122 having an actuator 124 that controls the means 80 for selectively moving the proximal grinding wheel 40 and the distal grinding wheel 60 (FIG. 1). The grinding wheels 40 and 60 are somewhat conical in shape.

In use, the external drive shaft 50 and the internal drive shaft 70 are coupled to the source of rotational kinetic energy 90 to rotate each grinding wheel 40, 60. The grinding wheels 40, 60 are then moved close enough together by actuating the moving means 80 so that an arc of both grinding wheels 40,60 may be placed into the concrete joint 30. The grinding wheels 40, 60 are then moved apart from each other by releasing the moving means 80 until the grinding implements 45, 65 of each grinding wheel 40, 60 contact the inside surface 20 of the concrete joint 30. The wheeled support frame 120 is then rolled along the concrete surface proximate the joint 30, each grinding wheel 40,60 grinding the inside surfaces 20 thereof.

While a particular form of the invention has been illustrated and described, it will be apparent that various modifications can be made without departing from the spirit and scope of the invention. Accordingly, it is not intended that the invention be limited, except as by the appended claims.

What is claimed is:

1. An apparatus for grinding both inside surfaces of a concrete joint simultaneously, comprising:

a proximal grinding wheel having a rotational axis orthogonally intersecting a center thereof, proximal and distal sides, at least one peripheral edge connecting the proximal and distal sides, at least one grinding implement fixed with the distal side proximate the peripheral edge thereof, and an external drive shaft co-aligned with the rotational axis and fixed at a distal end thereof to the center of the proximal grinding wheel;

a distal grinding wheel having the rotational axis orthogonally intersecting a center thereof, proximal and distal sides, at least one peripheral edge connecting the proximal and distal sides, at least one grinding implement fixed with the distal side proximate the peripheral edge thereof, and an internal drive shaft co-aligned with the rotational axis, fixed at least partially within the external drive shaft, and fixed at a distal end thereof to the center of the distal grinding wheel;

a means for selectively moving the proximal and distal grinding wheels apart by telescoping the internal and external drive shafts;

a source of rotational kinetic energy; and a means for selectively coupling the source of rotational kinetic energy to each drive shaft;

whereby with the grinding wheels coupled to the source of rotational kinetic energy to rotate the grinding wheels, and with the grind wheels moved close enough together so that an arc of both grinding wheels may be placed into the concrete joint, the grinding wheels may be moved apart from each other until the grinding implements of each wheel contact the inside surfaces of the concrete joint to grind same.

2. The apparatus of claim 1 wherein the source of rotational kinetic energy is a gasoline engine.

3. The apparatus of claim 1 wherein the source of rotational kinetic energy is an electric motor electrically connected to an electric power source.

4. The apparatus of claim 1 wherein each grinding wheel is generally conical in shape such that the distal ends of each grinding wheel extend distally beyond the centers of each grinding wheel, the grinding wheels being nestable.

5. The apparatus of claim 1 wherein the means for selectively moving the proximal and distal grinding wheels apart include a longitudinal slot in the external drive shaft and a pin fixed to the internal drive shaft and extending through the slot of the external drive shaft, an actuator being further included to move the pin within the slot to change the mutual proximity of the grinding wheels.

6. The apparatus of claim 1 wherein a biasing means is included within the external drive shaft at a proximal end thereof that biases a proximal end of the internal drive shaft away from the proximal end of the external drive shaft, whereby the distal grinding wheel is biased away from the proximal grinding wheel.

7. The apparatus of claim 1 wherein the means for selectively coupling the source of rotational kinetic energy to each drive shaft includes a drive belt looped around a motor pulley and a shaft pulley, the motor pulley fixed to the source of rotational kinetic energy and the shaft pulley selectively coupled to the external drive shaft through a clutch means.

8. The apparatus of claim 7 further including a wheeled support frame fixed to the source of rotational kinetic energy, means for selectively moving the proximal and distal grinding wheels apart, the proximal and distal grinding wheels, and the means for selectively coupling the source of rotational kinetic energy to each drive shaft, the support frame further including a handle having actuator controls for the means for selectively moving the proximal and distal grinding wheels apart and the clutch means.

9. A method for grinding inside surfaces of a concrete joint, comprising:

a) providing a proximal grinding wheel having a rotational axis orthogonally intersecting a center thereof, proximal and distal sides, at least one peripheral edge connecting the proximal and distal sides, at least one grinding implement fixed with the distal side proximate the peripheral edge thereof, and an external drive shaft co-aligned with the rotational axis and fixed at a distal end thereof to the center of the proximal grinding wheel; a distal grinding wheel having the rotational axis orthogonally intersecting a center thereof, proximal and distal sides, at least one peripheral edge connecting the proximal and distal sides, at least one grinding implement fixed with the distal side proximate the peripheral edge thereof, and an internal drive shaft co-aligned with the rotational axis, fixed at least partially within the external drive shaft, and fixed at a distal end thereof to the center of the distal grinding wheel; a means for selectively moving the proximal and distal grinding wheels apart by telescoping the internal and external drive shafts; a source of rotational kinetic energy; and a means for selectively coupling the source of rotational kinetic energy to each drive shaft;

b) coupling the drive shafts to the source of rotational kinetic energy to rotate the grinding wheels;

c) moving the grind wheels mutually close enough so that both wheels may be positioned within the concrete joint;

d) positioning at least a portion of both grinding wheels into the concrete joint; and e) moving the grinding wheels apart from each other until the grinding implements of each wheel contact the inside surfaces of the concrete joint.

10. The method of claim 9 wherein steps b) and c) are interchanged.

11. The method of claim 9 wherein step b) is moved after step d).

* * * * *